United States Patent [19]

Morisaki

[11] 4,337,808

[45] Jul. 6, 1982

[54] SUPER-SURFACER

[75] Inventor: Itsuo Morisaki, Amagasaki, Japan

[73] Assignee: Morisaki Jutakusangyo Kabushiki Kaisha, Hyogo, Japan

[21] Appl. No.: 164,095

[22] Filed: Jun. 30, 1980

[30] Foreign Application Priority Data

Aug. 31, 1979 [JP] Japan ..... 54-111844
Mar. 24, 1980 [JP] Japan ..... 55-37780

[51] Int. Cl.[3] ..... B27C 1/14

[52] U.S. Cl. ..... 144/114 A; 51/74 BS; 51/246; 144/120

[58] Field of Search ..... 51/5 B, 74 BS, 109 BS, 51/246, 247, 250; 144/114 R, 114 A

[56] References Cited

U.S. PATENT DOCUMENTS 563,105 6/1896 Vivakhas ..... 144/114 A
946,635 1/1910 Franke ..... 144/114 A
962,047 6/1910 Peterson ..... 144/114 A
1,193,295 8/1916 Perkins ..... 144/114 A
3,354,589 11/1967 Postula et al. ..... 144/114 A

*Primary Examiner*—W. D. Bray
*Attorney, Agent, or Firm*—Eugene E. Geoffrey, Jr.

[57] ABSTRACT

A super-surfacer used for super-finishing a surface of timber, wherein the shaving blade has a length which is much larger than the width of the working table and is arranged to be movable reciprocally in a direction transversely to the timber feeding direction, and a pair of grind stones are located on both sides of the table and in constant contact with the shaving blade to sharpen it, so that, with the reciprocal movement of the blade, all portions of the blade are sharpened by the grind stones just before they are used for shaving operation, and the machine can therefore be continuously operated without need of interruption of operation for sharpening or exchange of the shaving blade which has become dull.

6 Claims, 8 Drawing Figures

SUPER-SURFACER

This invention relates to an improved super-surfacer used for super-finishing a surface of timber.

While machines for shaving or cutting the surface of timber can be classified into "planers" having rotary blades and "super-surfacers" having stationary blades, this invention relates to the latter. The super-surfacer is generally used for super-finishing a surface of timber which has previously been shaved by the planer. Typical examples of the super-surfacer are disclosed in Japanese Utility Model Publication Nos. 45-23439 and 51-54317. In these examples, the shaving blades are held stationary during the shaving operation though they can be moved to change the angle between their knife edges and the timber feeding direction. However, the shaving blade may become gradually dull or its knife edge may become nicked eventually during use, and it becomes necessary to exchange the blade. In that case, however, the machine must be stopped and, of course, the shaving operation must be interrupted during the exchange operation. Although, in the example described in the above Japanese Publication No. 51-54317, there is provided a rotational table to which a plurality of shaving blades are attached, so that one blade can be exchanged while another blade is used, the operation must be interrupted in practice for the purpose of setting-up the exchanged blade. The period for which a shaving blade can be satisfactorily used continuously after it is sharpened corresponds generally to about 50 meters of shaving length of timber and, in order to improve uniformity in quality of the finished surface, the shaving blade must be renewed more frequently. This results in reduction of working ratio and, moreover, it is a reason why the machine cannot be adopted in a continuous production line.

Accordingly, an object of this invention is to provide a novel super-surfacer which enables sharpening and restoration of the shaving blade without the need for interruption of the shaving operation.

According to this invention, a super-surfacer includes a shaving blade with a relatively long knife edge, which can move in a direction transverse to the timber feeding direction and is arranged to execute the shaving opertion with a part of the shaving blade and, at the same time, an edge sharpening operation with another part of said blade, as the blade is moved continuously. With automatic reciprocation of the shaving blade, the whole length of the knife edge is successively used for shaving and, then, sharpened, and the blade is always keen-edged and can make a superior finished surface. Moreover, means are provided to raise the shaving blade by the amount of reduction of the knife edge due to sharpening operation and, by adjusting the blade manually or automatically during the operation, a continuous operation can be effected without need for frequently exchanging the shaving blade as in the case of prior art.

These and other objects and features of this invention will be described in more detail hereinunder with reference to the accompanying drawings.

IN THE DRAWINGS

Throughout the drawings, like reference numerals are used to denote like structural components.

Figure 1:
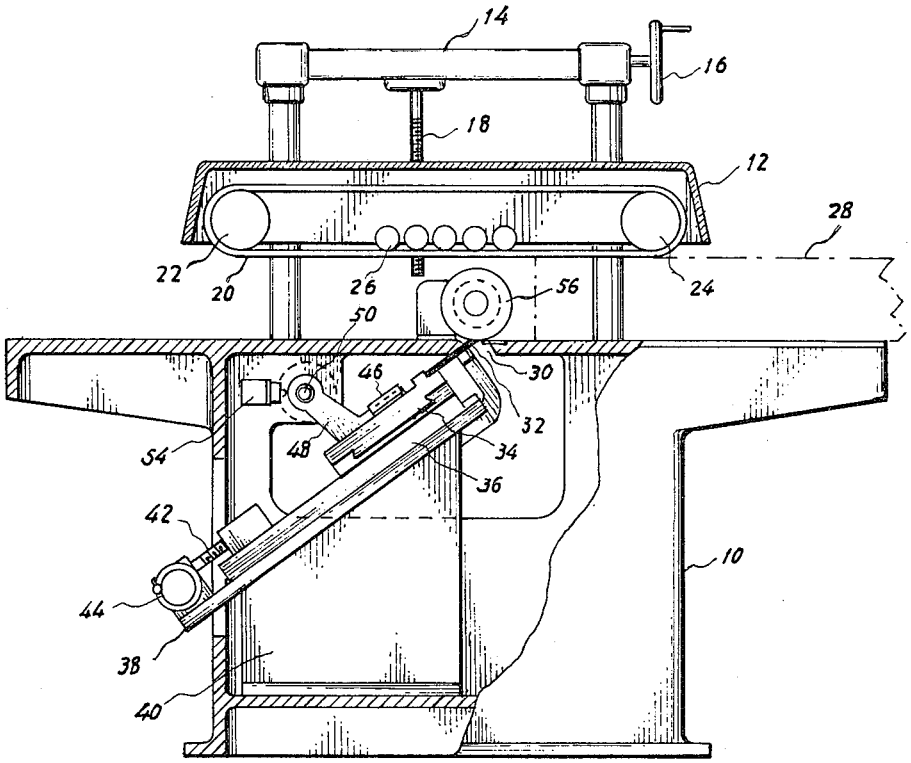
FIG. 1 is a partly broken-away front view representing a super-surfacer embodying this invention.

Referring to FIG. 1, the super-surfacer includes a table 10 and a timber feeding mechanism 12 which is supported by a support frame 14 fixed to the table 10 and movable vertically by means of a handle 16 and a feed screw 18. The timber feeding mechanism 12 comprises an endless rubber belt 20 which is supported between a pair of driving rollers 22 and 24 and urged downwardly by a plurality of idler rollers 26. This mechanism serves to move a timber 28 (shown in phantom) to be worked along the upper surface of the table 10 at an adequate speed by inserting the timber between the belt 20 and the upper surface of the table 10. As the above mentioned mechanism is common to conventional super-surfacers, further description is not deemed necessary.

Figure 2:
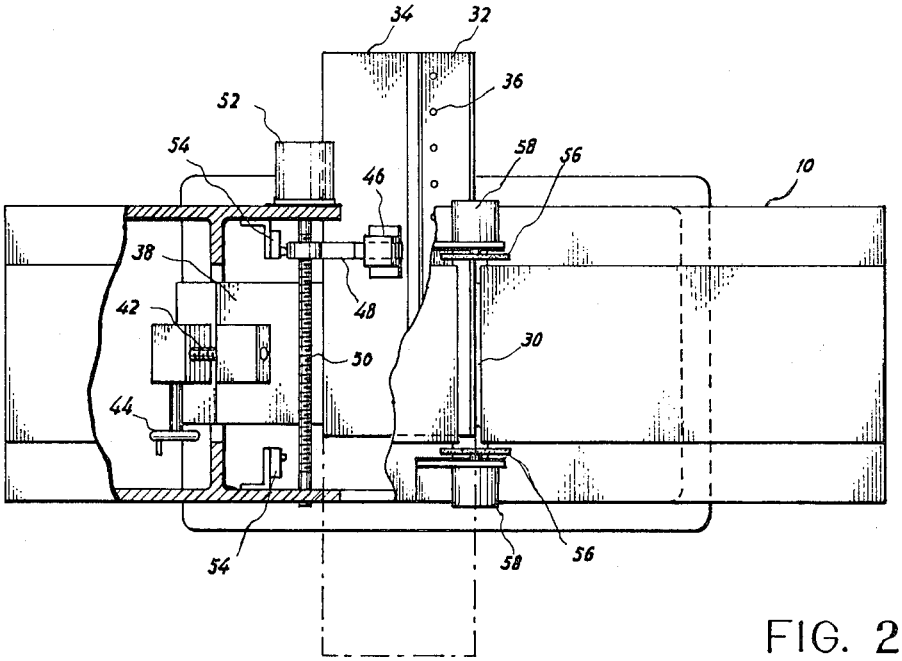
FIG. 2 is a partly broken-away plan view of the super-surfacer of FIG. 1.

Referring to FIGS. 1 and 2, a slot 30, which is referred to as the "blade slot, " is formed laterally or transversely to the timber feeding direction in the upper surface of the table 10 and a shaving blade 32 extends obliquely upwardly through the slot. As shown in FIG. 2, the length of the knife edge of this blade 32 is slightly longer than twice the length of the blade slot, and the blade 32 is fixed to a blade holder 34 having a comparable length by a number of screws 36. The blade holder 34 has a dovetail on the bottom face, which engages a dovetail groove formed in the upper face of a first slide bed 36 and can slide in the direction which is parallel to the knife edge of the blade, that is, transversely to the timber feeding direction. The first slide bed 36 extends obliquely downwards along the direction orthogonal to the blade holder 34 and has in the bottom face a dovetail groove which is orthogonal to the dovetail groove in the upper face thereof and engages a dovetail provided on the upper face of a second slide bed 38. The second slide bed 38 is fixed to the table 10 by means of a base 40. The first slide bed 36 is coupled to the second slide bed 38 through a feed screw 42 and can be finely moved up and down together with the blade holder 34 and the blade 32 along the ramp face of the second slide bed 38 by rotating the handle 44 which is mechanically coupled to the feed screw 42.

A block 46 having a square groove in the lower face is fixed to the center of the upper face of the blade holder 34 and one arm of an L-shaped bracket 48 slidably engages the square groove. Another arm of the bracket 48 has a threaded screw hole which meshes with a screw rod 50 supported horizontally in parallel to the knife edge of the blade 32 between the front and back walls of the table 10. The screw rod 50 is rotated by a reversible rotation mechanism 52 attached to the table 10 and moves the blade holder 34 and, in turn, the blade 32 in parallel to the screw rod 50 through the bracket 48. A pair of microswitches 54 are provided on the inner faces of the front and back walls of the table 10 so as to be operated by the bracket 48, and the reversible rotation mechanism 52 is arranged to interlock with these microswitches 54 so that it can reverse the direction of rotation when the switches act. The reversible rotation mechanism 52 is driven at a suitable speed by a motor (not shown) and, thus, the blade 32 moves forwards and backwards along and in the blade slot 30. It is desirable to position the microswitches 54 so that the blade 32 can be used for cutting or shaving throughout the substantially whole length thereof.

A pair of circular grind stones 56 are provided in the vicinities of both ends of the blade slot 30 on the table 10 and rotated respectively by motors 58 which are fixed to the table 10. While these grind stones must be positioned so that they are in contact with the knife edge of the blade 32 to sharpen it at their positions and the sharpened edge exhibits an optimum state of shaving with respect to the timber 28, it is desirable to provide a suitable horizontal and vertical fine movement mechanism (not shown) for this purpose. Thus, the blade 32 shaves and finishes the timber 28 moved by the feeding mechanism 12 on the table 10 and constantly moves forwardly and backwardly in the horizontal direction while being continuously sharpened by both grind stones 56. The amount of reduction of the knife edge due to the sharpening operation may be compensated by rotating the handle 44 manually to move the first slide bed 36 upwardly. It is a matter of course that this compensating operation may be automated.

Figure 3:
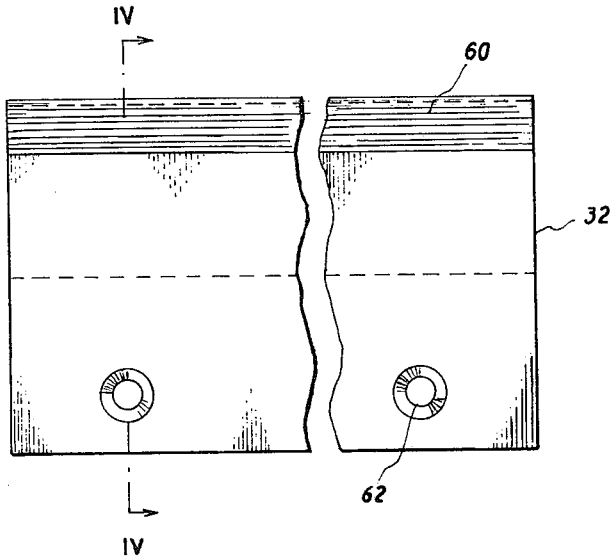
FIG. 3 is a partial plan view representing an embodiment of the shaving blade used in the embodiment of FIGS. 1 and 2.
Figure 4:
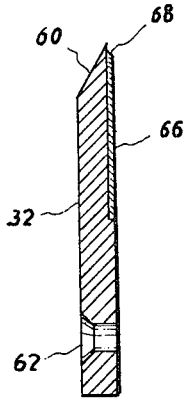
FIG. 4 is a cross-sectional view of the shaving blade of FIG. 3 taken along the line 4—4 thereof.
Figure 5:
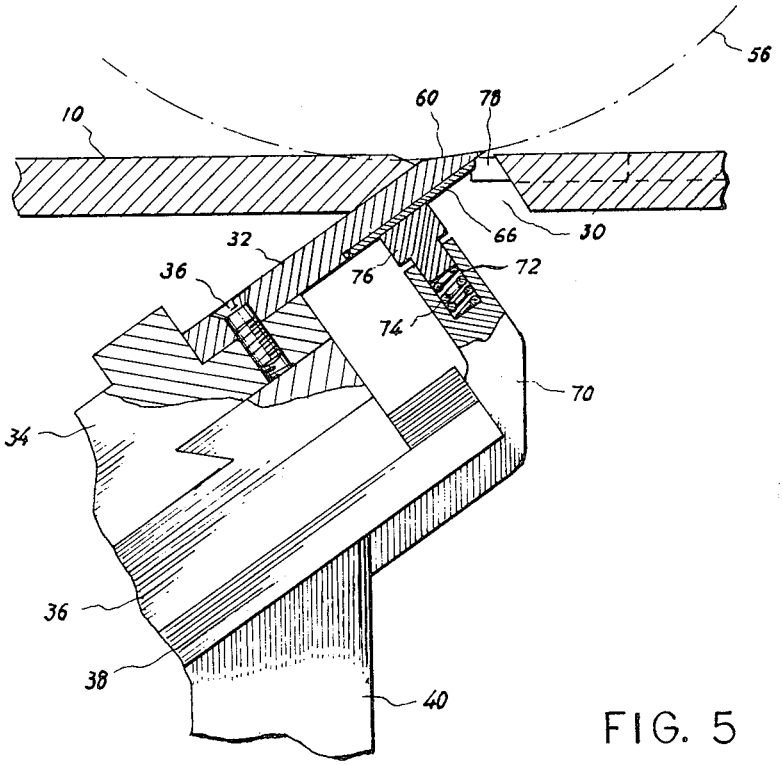
FIG. 5 is an enlarged partial cross-sectional view representing a fragmentary portion of the embodiment of FIGS. 1 and 2.

As shown in FIGS. 3 and 4, the shaving blade 32 used in the abovementioned super-surfacer consists of an elongated rectangular plate of high-carbon steel or other suitable material and one of its major sides is ground obliquely at a suitable angle to form a knife edge 60. Tightening through-holes 62 are provided in the vicinity of the other major side for fixing to the blade holder 34 with screws 36 as shown in FIG. 5. The blade 32 has a soft metal plate 66 which is soldered or adhered to the lower face thereof and a ramp face 68 is also formed at the edge of the metal plate 66 adjoining the knife edge 60. The apex of this ramp face 68 is positioned slightly behind the apex of the knife edge 60 and serves to wind up shavings produced from the knife edge 60 to facilitate removal thereof. That is, the metal plate 66 corresponds to the backing metal of the hand planer. The material of the metal plate 66 is preferably a soft metal such as aluminum or bronze for the reason described later. FIG. 5 shows detailed arrangement of the various components at and near the blade slot 30 of the table 10. The shaving blade 32 fixed to the blade holder 34 with the screws 36 has the knife edge 60 exposed upwardly from the blade slot 30 of the table 10. An L-shaped support arm 70 extends from the base 40 and has a top facing the lower face of the blade 32. A cavity 72 is formed in the top of the support arm 70 and a portion of a cylindrical member or urging pad 76 is inserted in the cavity 72 together with a compression spring 74. Thus, the spring 74 and pad 76 will urge the blade 32 against one of the walls of the blade slot 30 to fix the vertical position of the knife edge 60. As aforementioned, the shaving blade 32 is reciprocated in the slot 30 and the knife edge 60 is sharpened by the grind stone 56 (shown in phantom in FIG. 1). A forming tool 78 (FIG. 5) extends from the opposite wall of the blade slot 30, so that the aforementioned ramp face 68 of the metal plate 66 (FIG. 4) is cut and shaped thereby with movement of the blade 32.

Figure 6:
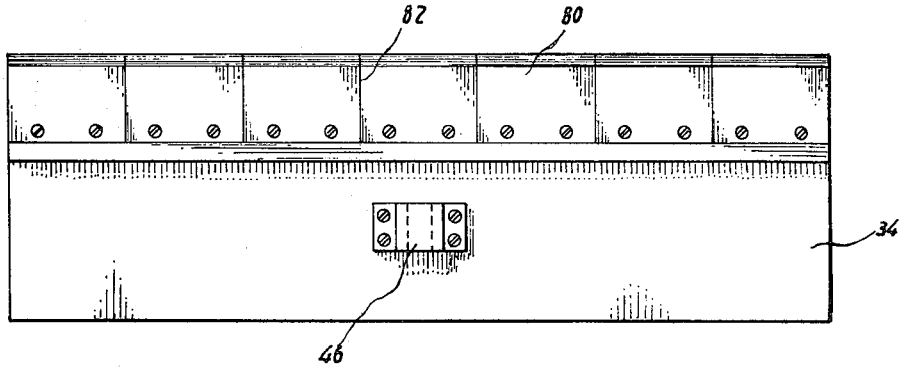
FIG. 6 is a plan view of another embodiment of the shaving blade assembly used in the super-surfacer of this invention.
Figure 7:
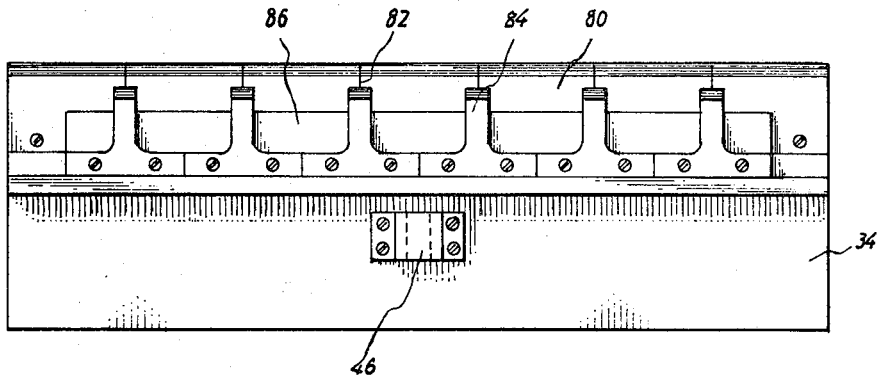
FIG. 7 is a plan view of a further embodiment of the shaving blade assembly used in the super-surfacer of this invention.
Figure 8:
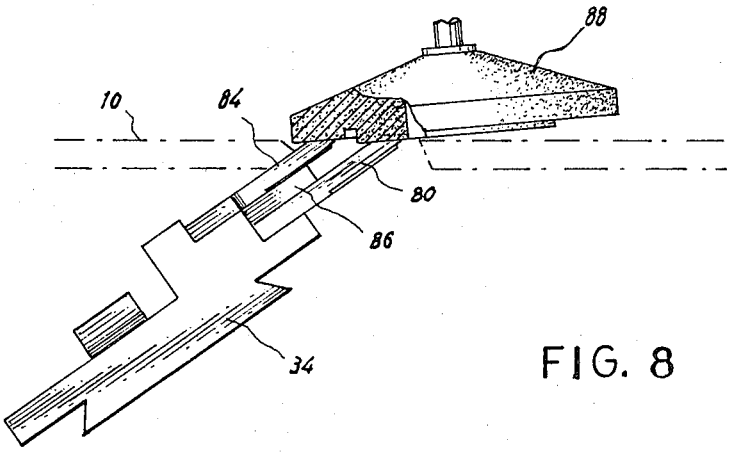
FIG. 8 is a side view of the embodiment of FIG. 7 shown in an operating position in a super-surfacer.

In the present super-surfacer, the machine can be operated continuously for a long period of time, since the blade 32 is sharpened by the grind stones 56 just before shaving and does not become dull. However, if the knife edge is nicked by any cause, it is necessary to exchange the whole blade 32 or to repair it by grinding it for a long time. FIG. 6 shows a modification for overcoming this problem. As clearly shown in the drawing, in this modification, the shaving blade is divided into a plurality of blade segments 80 of the same shape to enable substitution of the nicked blade segment only. In this structure, however, there are small gaps 82 between the respective blade segments 80, which produce ridge stripes on the finished surface. This is undesirable when a high quality of finished surface is required. FIGS. 7 and 8 show another modification having second blade segments 84 for removing the ridge stripes left by the gaps 82. In the drawing, the blade segments 80 are the same as those in FIG. 6 and fixed to the blade holder 34 similarly as in the case of FIG. 6. On the blade segments 80, auxiliary blade segments 84 are fixed through a spacer plate 86 in the positions corresponding to the gaps 82. The positional relationship of the auxiliary blade segments 82 and the main segments 80 is adjusted to that both blade segments will cut in the same plane. Although the width of the auxiliary blade segment 84 is shown to be less than that of the main blade segment 80 in FIG. 7, these auxiliary blade segments 84 may be substituted with those which are exactly the same as the main blade segment 80. In order to sharpen double blades as shown in FIG. 7, it is desirable to use a precisely shaped grind stone as shown in FIG. 8 to sharpen the blades 80 and 84 at the same time.

Although the above description of this invention has been made in conjunction with the embodiments as shown, this does not mean any limitation of this invention and various changes and modifications can be made within the scope of invention defined by the appended claims.

For example, while, in the embodiment of FIG. 7, the main and auxiliary blade segments 80 and 84 are both fixed to a common blade holder 34 to compensate the defect of the embodiment of FIG. 6, two blade assemblies which are the same as shown in FIG. 6 may be located in two separate blade slots in the surface of the table, together with their driving means 36–54 and the like, so that the blade gaps 82 of both assemblies are offset from each other.

What is claimed is:

1. A super-surfacer provided with a table, a blade slot formed laterally in the surface of said table, an inclined shaving blade extending through said blade slot for shaving timber fed longitudinally along the surface of said table passed said shaving blade, at least a portion of said slot and protruding blade edge defining a blade shaving position, the length of the knife edge of said shaving blade being longer than the width of said blade slot, means for reciprocally moving said shaving blade relative to said slot and means for sharpening said shaving blade, said sharpening means being positioned adjoining at least one end of said slot and displaced from the blade shaving position whereby said shaving blade upon being reciprocated is sharpened by said sharpening means.

2. A super-surfacer according to claim 1 including second sharpening means positioned adjoining the other end of said slot and displaced from the blade shaving position whereby a portion of said blade is always disposed at the shaving position and both said sharpening means function to repetitively sharpen all portions of said blade during reciprocation thereof.

3. A super-surfacer according to claim 1 wherein said moving means includes a base fixed to said table, a first movable bed carried by said base and movable in the direction of the projection of said shaving blade, means for moving said first movable bed with respect to said base, a second movable bed carried by the first movable bed and supporting said shaving blade, said second movable bed being movable in a direction parallel to said blade slot and means for reciprocating said second movable bed.

4. A super-surfacer according to claim 1 wherein said shaving blade has a plate of soft metal adhered to the surface opposite to the sharpened surface, and said table having a cutting tool fixed thereto to contact the top edge of said metal plate, whereby said tool cuts said metal plate to form a ramp face at a position slightly to the rear of the knife edge of said blade when said blade is reciprocated by said moving means.

5. A super-surfacer according to claim 1, 2 3 or 4 wherein said shaving blade consists of a plurality of substantially identical segments positioned in abutting relationship one to the others.

6. A super-surfacer according to claim 5 wherein additional shaving blades are positioned in overlying relationship to said blade segments and in bridging relationship to adjoining edges of said blade segments.

* * * * *